US005524758A

United States Patent [19]

Lupul

[11] Patent Number: 5,524,758

[45] Date of Patent: Jun. 11, 1996

[54] AUTHENTICATION PACKAGING FOR REPLACEMENT PARTS

[76] Inventor: Troy D. Lupul, P.O. Box 2443, Canmore, Alberta, Canada, T0L 0M0

[21] Appl. No.: 497,235

[22] Filed: Jun. 30, 1995

[51] Int. Cl.[6] ..... B65D 5/54; B42D 15/00

[52] U.S. Cl. ..... 206/459.5; 206/831; 229/242; 283/67; 283/94

[58] Field of Search ..... 206/459.1, 459.5, 206/831; 229/240–242; 283/74, 94, 67, 70; 383/204–207

[56] References Cited

U.S. PATENT DOCUMENTS

| | | | |
|---|---|---|---|
| 1,824,862 | 9/1931 | Young | 229/242 |
| 2,129,363 | 9/1938 | Simons et al. . | |
| 2,999,698 | 9/1961 | Hoese . | |
| 3,567,108 | 3/1971 | Corridon | 206/459.5 |
| 3,950,013 | 5/1976 | Tagliaferri . | |
| 4,165,002 | 9/1979 | Meagher . | |
| 4,585,254 | 5/1986 | Adams . | |
| 4,651,877 | 3/1987 | Adrianus de Mooy . | |
| 4,836,378 | 6/1989 | Lephardt . | |
| 4,838,424 | 6/1989 | Petzelt . | |
| 4,872,555 | 10/1989 | Shadrach, III et al. . | |
| 4,972,953 | 11/1990 | Friedman et al. | 206/459.1 |
| 4,976,456 | 12/1990 | Jack . | |
| 4,991,878 | 2/1991 | Cowan et al. . | |
| 5,042,842 | 9/1991 | Green et al. . | |
| 5,340,158 | 9/1994 | Bartl . | |
| 5,372,386 | 12/1994 | Mills . | |

*Primary Examiner*—Jimmy G. Foster

*Attorney, Agent, or Firm*—Jones, Tullar & Cooper

[57] ABSTRACT

The present invention relates to a simple, inexpensive but effective authentication system and package which will enable end users of replacement parts to quickly and easily ascertain the authenticity of the parts contained in the package without necessitating the use of additional authentication equipment. In general, the authentication system for replacement parts of the present invention comprises a package constructed of a multi-layer material such as corrugated cardboard, having located between two of its layers a tear tape. The tear tape is inserted between the layers during manufacture of the multi-layered material and in such a manner that when the material is formed into packages, the tear tape will extend around a substantial portion of the package and cannot be removed without destroying the package or at least rendering it unreusable. Before the tear tape is inserted into the multi-layered material, the tear tape is inscribed or coded with predetermined indicia that is matchable with the part to be contained in the package. Since the tear tape is located between layers of the package material, neither it nor its inscription are visible from either the outside or inside of the package. Once the packaged part reaches its final destination, the end user authenticates the part by removing the tear tape from the package and comparing the inscription to the part contained therein. The manner in which the system is implemented, i.e. by including an operation during the package manufacture which can only be carried out by few companies because of the size and cost of the equipment involved, but which equipment is normally employed during the package manufacture, deters counterfeiting of the replacement parts.

20 Claims, 3 Drawing Sheets

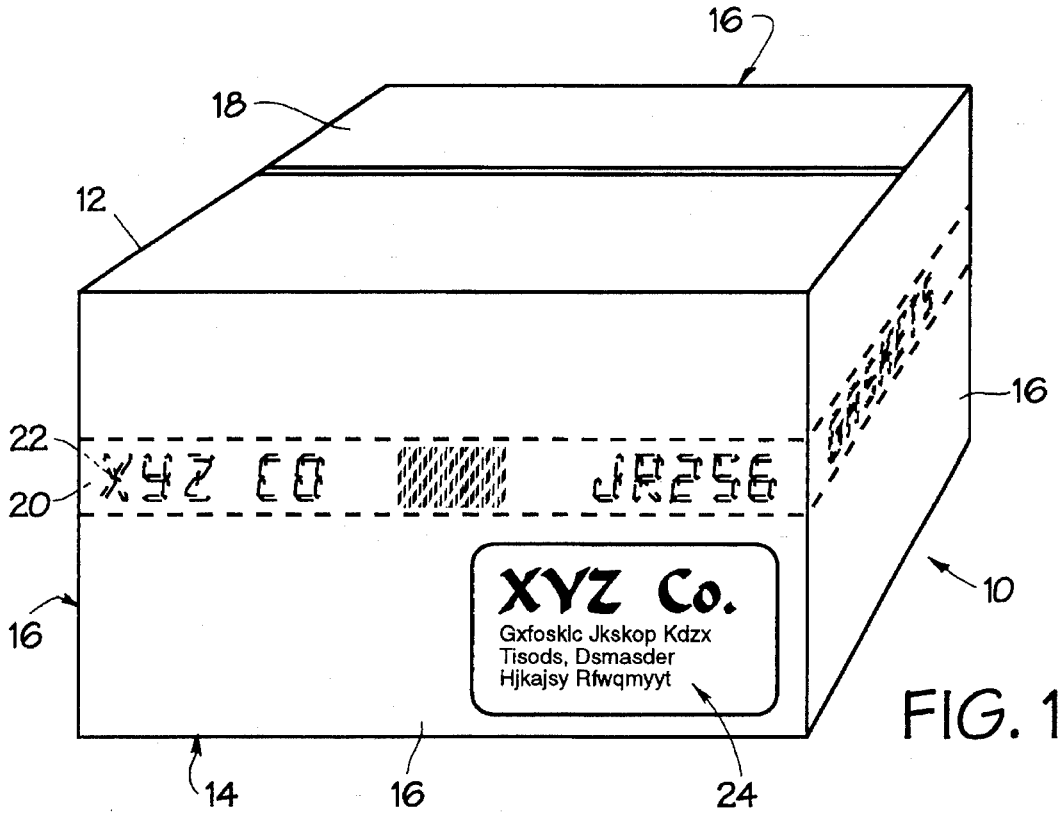
FIG. 1
FIG. 2
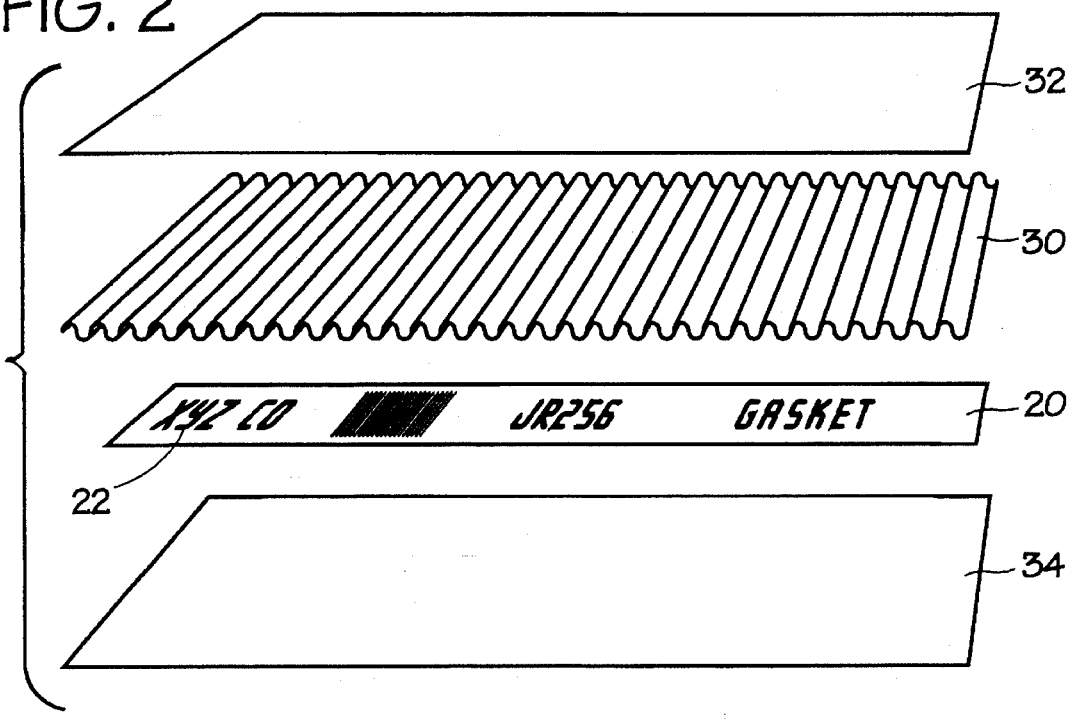

AUTHENTICATION PACKAGING FOR REPLACEMENT PARTS

FIELD OF THE INVENTION

The present invention relates to an authenticating system for packaged replacement parts and, in particular, to an inexpensive authentication package which will enable the end user of the packaged product to verify its authenticity upon opening the package.

BACKGROUND OF THE INVENTION

The replacement parts industry has been shown to be vulnerable to counterfeit or bogus parts introduced into the system by counterfeiters through parts brokers and distributors. Once in the system, these counterfeit parts are virtually undetectable and indistinguishable from genuine parts. Counterfeit parts have the look, feel and fit of a genuine part, but they tend to lack the qualifying specifications of the genuine part. The rigorous specifications required of parts, especially those in high technology industries such as aerospace, military, automobile, heavy equipment and electronics, tend to render genuine parts relatively expensive. Where parts are critical for the safety of people, government or industry standards are quite high and can usually only be met by the most qualified of manufacturers. To adhere to such high standards is an expensive proposition and which, therefore, results in expensive parts.

By utilizing substandard specifications in materials and manufacture, both of which result in relatively inexpensive parts, counterfeiters have much to gain in the way of profit and the temptation has made this underground industry flourish. Counterfeit parts can comprise those made from substandard materials and to substandard tolerances which are made to look and feel exactly alike their authentic counterparts. They can also consist of refurbished authentic parts which have been cleaned and polished to look like new. Many of these refurbished parts are ones which have been removed for safety purposes since they have reached their designed service life and their re-entry into service as a purportedly new part is extremely hazardous. In both instances, the counterfeit parts are passed off as genuine and/or new, typically through the use of replicated or reused printed packaging bearing the indicia of the manufacturer of the genuine parts. For counterfeiters, it is not difficult to obtain packaging, particularly corrugated cardboard boxes, of equal sizes as those in which the authentic parts are packaged. It is also not difficult with today's laser printing techniques and computer software to print, either on labelling or directly onto the package, indicia including the genuine manufacturer's logo to falsely suggest that the product contained in the package originated with that reputable manufacturer. It is also known that some counterfeiters obtain packaging which was originally genuine, but which had been discarded once opened and the part removed. Oftentimes, the replaced part is discarded in the package of the replacement part, thereby affording the counterfeiter both a refurbishable part and a package in which it can be shipped. For the end-users of these parts, it is impossible to ascertain from the part itself or from its packaging that the part is anything but authentic.

Currently available authenticating systems tend to utilize expensive, difficult to replicate, techniques to deter counterfeiting. Many such systems require the end-user to employ expensive authentication equipment for verification purposes. However, in remote locations, while it is often necessary that authenticity of a part be established, authentication equipment may not always be readily available. Whatever the case, these present techniques tend to add substantial costs to already expensive replacements parts.

SUMMARY OF THE INVENTION

It is therefore desirable and an object of the invention to provide an inexpensive authentication system for deterring counterfeiting of replacement parts. It is a further object of this invention to enable the end user to quickly and easily ascertain the authenticity of a part without necessitating the use of additional specialized authentication equipment. It is another object of this invention to provide an authentication system which, while inexpensive, is extremely difficult for counterfeiters to implement and, therefore, provides a reasonable assurance to the end user of the authenticity of the component. It is yet another object of this invention to provide an authentication system which correlates the package with its contained part whereby the verification step involves merely confirmation of the correlation. It is still a further object of the invention to provide an authentication package whereupon the package is rendered unreusable or is destroyed by the act of authenticating the component which was contained in the package.

The authentication system for replacement parts of the present invention comprises a package constructed of a multi-layer material such as corrugated cardboard, having located between two of its layers a tear tape. The tear tape is inserted between the layers during manufacture of the multi-layered material and in such a manner that when the material is formed into packages, the tear tape will extend around a substantial portion of the package and cannot be removed without destroying the package or at least rendering it unreusable. Before the tear tape is inserted into the multi-layered material, the tear tape is inscribed or coded with predetermined indicia that is matchable with the part to be contained in the package. Since the tear tape is located between layers of the package material, neither it nor its inscription are visible from either the outside or inside of the package. Once the packaged part reaches its final destination, the end user authenticates the part by removing the tear tape from the package and comparing the inscription to the part contained therein.

The overall process takes a coordinated effort especially between the parts manufacturer and the package manufacturer to ensure that package lots will be placed with corresponding parts lots. For the package manufacturer, who typically constructs packaging materials from stock supplies and subsequently forms the appropriate package, i.e box, envelope, etc., from the package material, the step of including a tear tape between layers of the packaging material is readily accomplished without significant added expense. However, the expensive, industrial equipment involved in manufacturing the package material, for example corrugated cardboard, is not accessible by counterfeiters. While a reputable packaging manufacturer might unknowingly provide regular packages to a counterfeiter operating under pretext, it would likely not knowingly supply authentication packages according to the present invention to anyone other that the genuine parts manufacturer or its authorized agent. Therefore, the inability of or cost to the counterfeiters to provide such a package in which to ship their counterfeit or bogus parts would substantially deter most counterfeiters from continuing business in this manner. For a minor expenditure in materials, an added step in the package material manufacturing process and a careful and coordinated effort of all involved, the potential savings to genuine parts manufacturers could be enormous notwithstanding the intangible benefits brought about by a renewed confidence in the replacement parts industry and the devices or vehicles in which the parts are employed.

These and further objects and advantages of the present invention will become more apparent from the description detailed hereinbelow with reference to the appended drawings wherein:

BRIEF DESCRIPTION OF THE DRAWINGS

FIG. 1 is a perspective view of a typical embodiment of an authentication package according to the present invention showing in hidden lines one possible positioning of the tear tape;

FIG. 2 is an exploded view of a portion of multi-layered packaging material including an inscripted tear tape;

DETAILED DESCRIPTION OF THE PREFERRED EMBODIMENT

Figure 3:
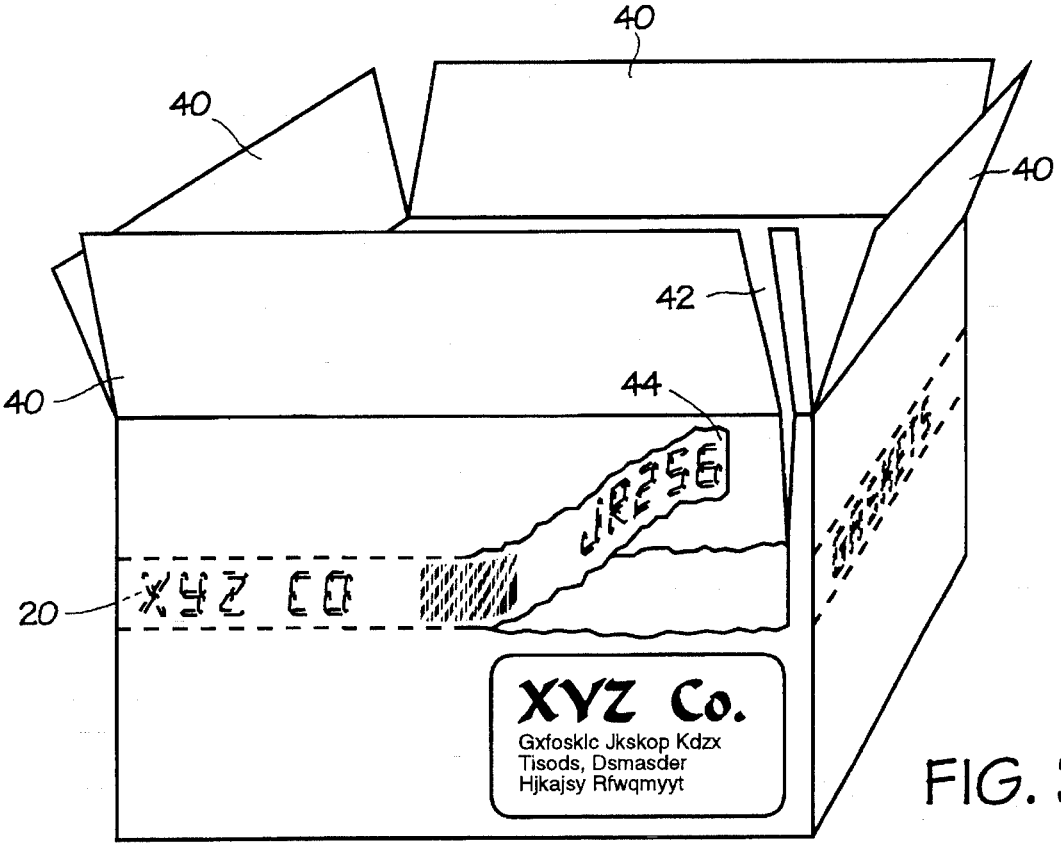
FIG. 3 is a perspective view of an opened authentication package with the tear tape in the process of being removed.

FIG. 1 illustrates generally at reference numeral 10 an authentication package in accordance with the present invention. In this case, the package 10 is in the form of a six-sided box 12 comprising a bottom 14, four upstanding side walls 16 and top 18. A tear tape 20 (shown in phantom) is provided within the walls 16 of the package. Preferably, the tear tape 20 extends substantially entirely around the perimeter of the box 12 for reasons which will also be explained below in greater detail. For illustrative purposes, the tear tape 20 is shown in FIG. 1 to extend around the side walls 16 of the package, although not shown, it will be understood that the tear tape 20 could extend around the periphery of the package in a variety of ways such as through two of the top flaps 40 (FIG. 3), two of the side walls 16 and the bottom 14. The tear tape 20 is provided with a coded inscription 22 which relates to the part or component contained in the package 10 in a predetermined manner. While both the tear tape 20 and the inscription 22 are shown (albeit in phantom) in FIG. 1, it should be realized that the tear tape 20 is located within the walls 16 of the box 12 and is not visible from either the outside or the inside of the package 10. Therefore, the authentication package 10 of the present invention is very inconspicuous and not distinguishable from an inspection of and comparison with a similar packaging not employing the present invention. To this end, the package 10 may include on its exterior the usual printed matter 24 normally contained on the package for identification, shipping and information purposes.

The preferred packaging material for use with the present invention is a multi-layered paper product, particularly but not necessarily restricted to corrugated cardboard. Corrugated cardboard is well suited to the present invention because the corrugation machinery used is typically extremely large and expensive and, therefore, only possessed by a relatively minor number of manufacturing companies, and usually only by those involved in the production of corrugated cardboard from stock paper material. Generally, corrugated cardboard consists of a layer of corrugated paper or cardboard sandwiched between at least two layers of facing paper or cardboard. However, for purposes of this invention, the packaging material need only comprise of a minimum of two layers, between which layers the tear tape can be inserted during the manufacturing process. FIG. 2 shows in an exploded view an example of the relative positioning of the layers of a typical corrugated cardboard packaging material and tear tape 20. As mentioned above, the corrugated cardboard material might comprise a corrugated layer 30 adhesively sandwiched between liner or facing layers 32,34. In accordance with the present invention, a tear tape 20 having indicia 22 thereon is inserted between the facing layer 34 and the corrugated layer 30 and retained therebetween either by the adhesive normally applied between these layers or by a different and/or additional adhesive applied for that purpose. The width of the tear tape is generally variable with respect to two considerations: the first being that it is sufficient to accommodate all of the desired indicia 22; and the second that while a wider tape might be easier to handle in the printing and package manufacturing process, it will necessitate a greater removal force when tearing it from the package.

The nature of the adhered tear tape 20 is such that its adhesive strength exceeds the strength of the corrugated cardboard material whereby any attempt to remove the tape 20 results in at least the portion of the corrugated cardboard material to which the tear tape 20 is adhered to be removed therewith. FIG. 3 in this regard illustrates the removal of the tear tape 20 from the package 10. The end user, knowing of the authentication system, opens the opening flaps 40 of the package and removes the part or parts (not shown) contained therein. The end user then cuts or rips as at 42 into the package side wall 16 to expose the tear tape 20. The tear tape 20 may also be cut (due to the strength of the tear tape, it might not be possible to tear the tape 20 itself by hand) at this point to provide an end 44 thereof which can be grasped. As indicated above, if the tear tape is provided around the package though two of the top flaps 40 (FIG. 3), two of the side walls 16 and the bottom 14, then the ends of the tear tape 20 would be more readily accessible. In either case, once exposed, the tear tape 20 is then ripped from the walls 16 of the package 10 and since, as explained above, the tear tape 20 preferably extends substantially entirely around the package 10, its removal destroys the package and/or renders it unreusable although still recyclable. Again, the paper structure of the corrugated cardboard material, while quite rigid as a packaging material, is well suited to this purpose since there is not an overwhelming amount of resistance to removal of the tear.

Figure 4:
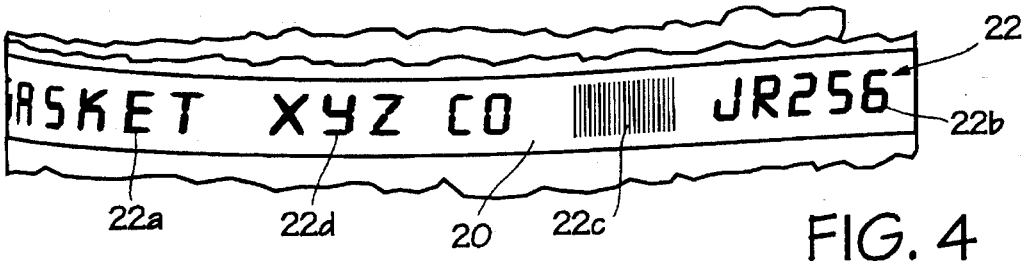
FIG. 4 is an overhead view of the removed tear tape doubled over on itself and showing thereon an example of the inscription code used for authenticating purposes.

The removed tear tape 20 is shown in more detail in FIG. 4. The coded inscription 22 thereon comprises at least some correlating indicia which can be matched or compared with the part or parts, or matching indicia thereon, originally contained in the package 10 for authentication purposes. In general, the tear tape is made of a flat, relatively high tensile strength material. An example is the nylon tear tape as provided by the 3M Company which is a strip of material composed of fibrous strands of nylon. In order for the tear tape 20 to be ripped or removed from the package, the tensile strength of the material must be greater than the tear strength of the package material. The strength property of the tear tape may be used advantageously to provide additional strength to the resulting package or to enable the package to be produced with less materials for a given strength. The printing technique used to inscribe the tear tape 20 depends significantly on the type of material chosen. The printing technique used should at least enable the indicia printed thereby to be readily discerned once the tear tape 20 is removed from the package. With the aforementioned fibrous nylon tear tape, the indicia 22 are impregnated in the material by ink jet, laser printing or impact printing so that, if necessary (due to portions of the package material adhering to the surfaces of the tear tape once removed), the tear tape can be delaminated so the indicia 22 is revealed. To this end, the tear tape 20 may also be comprised of a material which is separable along its thickness or which includes a plurality of separable and not necessarily similar layers. Depending on the type of tear tape used, it should be realized that it may be necessary to remove pieces of the package material which remain adhered to the removed tear tape in order to reveal the inscription.

Figure 5:
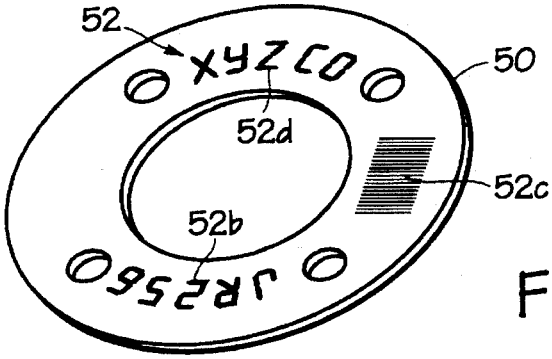
FIG. 5 is a plan view of a hypothetical component illustrating thereon indicia by which the coded tear tape can be compared for authentication purposes.

A hypothetical part, in this case a gasket 50, is shown in FIG. 5 having matching indicia 52 thereon. For example, the correlating indicia might comprise a description of the part 22*a*, a serial number or range of serial numbers 22*b* which are identified on the part (52*b*), or might comprise a bar code 22*c* or other machine readable symbols which can be visually compared and matched with corresponding indicia 52*c*. Further identifying indicia 22*d*,52*d* such as the part manufacturer' s name or trademarks may also be provided if desired. It is further possible that the inscription be encoded or encrypted to meet the customers authenticity requirements.

Figure 6:
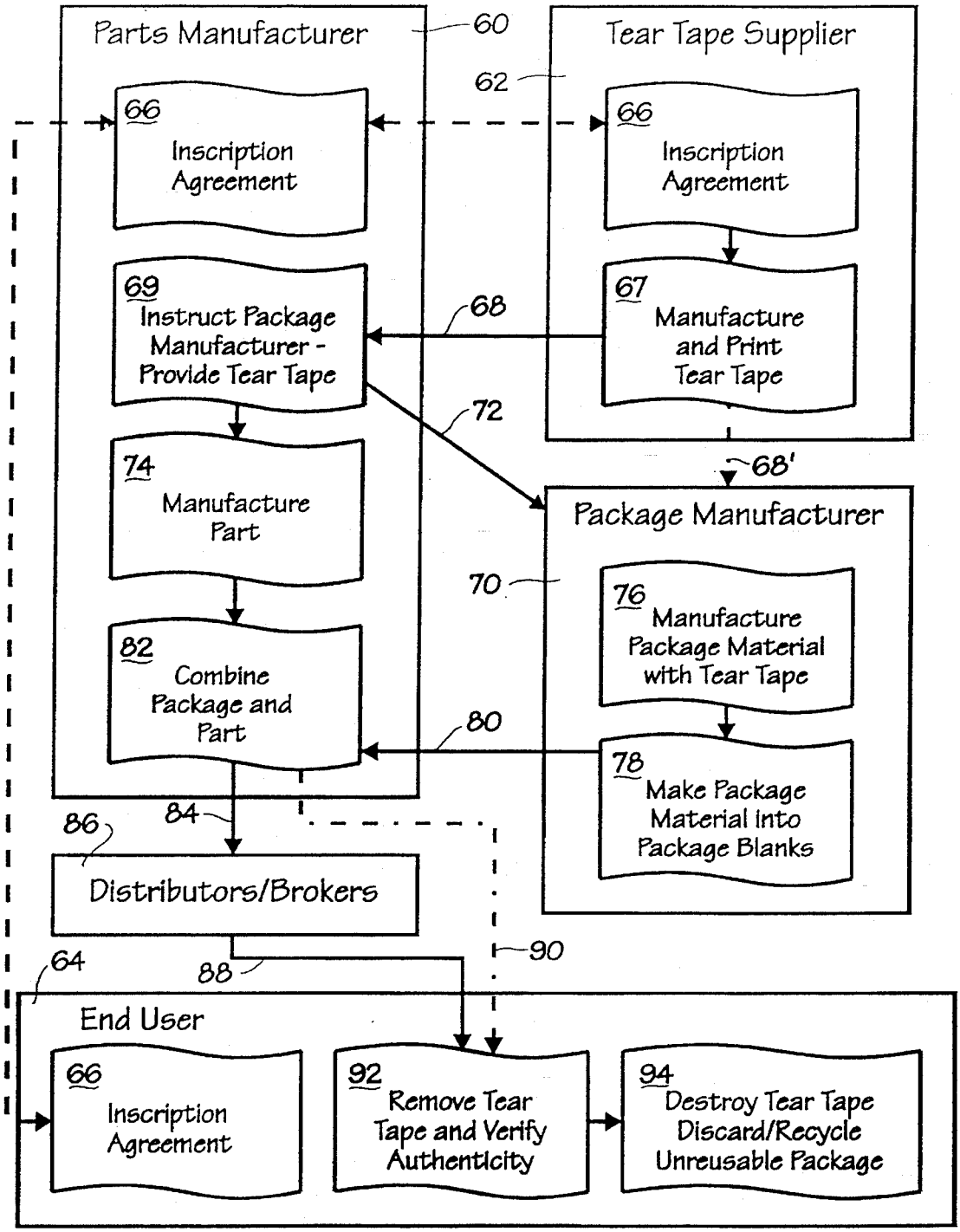
FIG. 6 is a flow diagram outlining the entire authentication process.

An exemplary overall authentication process is shown schematically in the flow chart of FIG. 6. The parts manufacturer 60 has an authentication packaging requirement which can be met by the packaging system of the present invention. The part manufacturer 60, the tear tape supplier 62 and possibly the customer or end user 64 agree at 66 on the inscription indicia to be provided on the tear tape for authenticating purposes. The tear tape supplier 62 manufactures the tear tape (67) and prints the agreed upon indicia thereon. The inscripted tear tape is either returned back to the parts manufacturer 60 (at 68) or directly to the packaging manufacturer 70 (at 68'). The parts manufacturer 60 then provides a request (at 72) to the package manufacturer 70 for a package of predetermined dimensions and material and provides the package manufacturer 70 with the tear tape (69), if not already provided by the tear tape supplier at 68'. The part is then manufactured at 74 and marked, if required, in the appropriate manner with matching indicia. The parts manufacturer 70 then manufactures the package material at 76 to include the supplied tear tape in the aforementioned manner and forms the package material into package blanks at 78 which are shipped back at 80 to the parts manufacturer 60. The parts manufacturer 60 then combines at 82 the package and the manufactured part and provides the packaged part to the end user 64 either through (84,88) distributors and/or parts brokers 86 or directly to the end user at 90. The end user 64 then verifies the authenticity of the part (92) by opening the package, removing the part, tearing or cutting the package to expose the tear tape, removing the tear tape, and comparing the correlating indicia on the tear tape with the part, or the matching indicia provided thereon. The tear tape is then destroyed at 94 and the package, being either destroyed or at least rendered unreusable through the removal of the tear tape, may then be discarded or recycled.

In the foregoing example, the tear tape supplier 62 has been shown as a separate entity or third party. It is, however, quite possible that the functions described with respect to the tear tape supplier could be carried out "in house" by the parts manufacturer 60 or the package manufacturer 70.

In summary, there has been shown and described a simple, inexpensive but effective authentication system and package which would enable end users of replacement parts to quickly and easily ascertain the authenticity of the parts without necessitating the use of additional authentication equipment. The manner in which the system is implemented, i.e. by including an operation during the package manufacture which can only be carried out by few companies because of the size and cost of the equipment involved, but which equipment is normally employed during the package manufacture, deters counterfeiting of the replacement parts. While a preferred embodiment of the invention has been illustrated, it will be understood that this embodiment is not to be considered limiting and that various modifications and adaptations can be made thereto without departing from the spirit and scope of the invention as defined in the appended claims.

I claim:

1. An authentication system for verifying the authenticity of a packaged replacement part comprising:

a package adapted to contain a replacement part, said package being constructed of a multi-layer material, said multi-layer material comprising at least two layers;

a tear tape adhered between said at least two layers and extending around a substantial portion of said package, said tear tape having printed thereon an inscription, neither said inscription nor said tear tape being visible from an inspection of the package;

said inscription comprising correlating indicia corresponding to said replacement part contained in said package;

said tear tape being removable from said package only by destroying said package or rendering said package unreusable, whereby, when removed, said correlating indicia on said tear tape can be compared with said replacement part to verify its authenticity.

2. The authentication system of claim 1, wherein said at least two layers are made of paper-based stock.

3. The authentication system of claim 1, wherein said multi-layer material is corrugated cardboard comprising a corrugation layer sandwiched between two facing layers, said tear tape being adhered between said corrugation layer and one of said facing layers.

4. The authentication system of claim 1, wherein said tear tape is fabricated of a relatively high tensile strength material as compared with the tear strength of the package.

5. The authentication system of claim 4, wherein said tear tape is separable or delaminatable along its thickness.

6. The authentication system of claim 1, wherein correlating indicia on said tear tape comprises a description of said replacement part contained in said package.

7. The authentication system of claim 1, wherein said replacement part has matching indicia thereon and wherein said correlating indicia is visibly matchable with said matching indicia when said tear tape is removed from said package.

8. The authentication system of claim 7, wherein said matching indicia is a serial number of the replacement part.

9. The authentication system of claim 7, wherein said matching indicia is printed and machine-readable.

10. The authentication system of claim 9, wherein said printed and machine-readable matching indicia is a bar code.

11. An authentication package having an interior and an exterior and containing at least one replacement part in the interior thereof, said authentication package constructed of a multi-layer material having adhered between at least two of said layers of said multi-layer material and extending substantially around a perimeter of the package a tear tape, said tear tape having correlating indicia thereon relating to said at least one replacement part in the interior of said package, neither said correlating indicia nor said tear tape being visible from the exterior or interior of the package; said tear tape being removable from said package by ripping said tear tape therefrom so as to destroy said package or render said package unreusable, said correlating indicia on said tear tape being comparable with said at least one replacement part to verify its authenticity.

12. The authentication system of claim 11, wherein said at least two layers are made of paper-based stock.

13. The authentication system of claim 11, wherein said multi-layer material is corrugated cardboard comprising a corrugation layer sandwiched between two facing layers, said tear tape being adhered between said corrugation layer and one of said facing layers.

14. The authentication system of claim 11, wherein said tear tape is fabricated of a relatively high tensile strength material as compared with the tear strength of the package.

15. The authentication system of claim 14, wherein said tear tape is separable or delaminatable along its thickness.

16. The authentication system of claim 11, wherein correlating indicia on said tear tape comprises a description of said replacement part contained in said package.

17. The authentication system of claim 11, wherein said replacement part has matching indicia thereon and wherein said correlating indicia is visibly matchable with said matching indicia when said tear tape is removed from said package.

18. The authentication system of claim 17, wherein said matching indicia is a serial number of the replacement part.

19. The authentication system of claim 17, wherein said matching indicia is printed and machine-readable.

20. The authentication system of claim 19, wherein said printed and machine-readable matching indicia is a bar code.

* * * * *